US005511455A

United States Patent [19]

Steinberger

[11] Patent Number: 5,511,455

[45] Date of Patent: Apr. 30, 1996

[54] CURVED TOP SOLID BODY GUITAR

[76] Inventor: Ned Steinberger, 1538 Jackson Ave., New Windsor, N.Y. 12553

[21] Appl. No.: 250,045

[22] Filed: May 27, 1994

[51] Int. Cl.[6] ..... G10D 3/00

[52] U.S. Cl. ..... 84/291; 84/267

[58] Field of Search ..... 84/267, 275, 291, 84/269

[56] References Cited

U.S. PATENT DOCUMENTS

| | | | |
|---|---|---|---|
| D. 27,561 | 8/1897 | Back | 84/267 |
| D. 43,684 | 3/1913 | Weymann | 84/267 |
| D. 242,074 | 10/1976 | Kasha et al. | D56/1 A |
| 676,470 | 6/1901 | Oakes | 84/267 |
| 1,179,499 | 4/1916 | Bohmann | 84/267 |
| 1,762,408 | 6/1930 | Nelson | 84/267 |
| 2,498,926 | 2/1950 | Mitchell | 84/267 |
| 2,793,556 | 5/1957 | Maccaferri | 84/267 |
| 3,641,862 | 2/1972 | Rendell | 84/291 |
| 3,880,040 | 4/1975 | Kaman | 84/291 |
| 4,056,034 | 11/1977 | Kaman | 84/267 |
| 4,290,336 | 9/1981 | Peavey | 84/291 |
| 4,539,886 | 9/1985 | Hoffart | 84/267 |
| 4,635,522 | 1/1987 | Excellente | 84/291 |
| 5,125,312 | 6/1992 | Fishman et al. | 84/291 |
| 5,235,891 | 8/1993 | Klein | 84/291 |

OTHER PUBLICATIONS

Exhibit B–Sketch of top surface of Steinberger Sound GL Series Bases (admitted to be prior art).

Price, "Making the turner Guitar" (describing the Turner guitar which is admitted to be prior art).

Exhibit A–Steinberger Sound Division of Gibson Guitar Corp. Brochure, Jan. 1, 1994.

*Primary Examiner*—Thomas M. Dougherty
*Assistant Examiner*—Patrick J. Stanzione
*Attorney, Agent, or Firm*—Lucian Wayne Beavers

[57] ABSTRACT

A stringed musical instrument includes a solid body having a length and a width. The body has a top surface shaped so that a widthwise cross section through the body intersects the top surface along a line defining a continuous convex curve, and so that a lengthwise cross section through the body intersects the top surface along a straight line. A wood veneer layer is bonded to the top surface.

12 Claims, 1 Drawing Sheet

CURVED TOP SOLID BODY GUITAR

BACKGROUND OF THE INVENTION

1. Field of the Invention

The present invention relates generally to the construction of solid body guitars, and more particularly, but not by way of limitation, to the construction of solid body guitars having a primary component molded from a composite plastic material, and having a wood veneer bonded to the top surface of the body.

2. Description of the Prior Art

In the field of solid body guitars, there have been many carved top guitars having curvaceous top surfaces. These instruments have generally, however, had complex surfaces so that a cross section across the width or across the length of the guitar at any particular point will typically intersect the top surface at a line which includes both convex and concave portions. Such complex carved top surfaces are relatively difficult to create and require a great deal of machining, milling and like operations.

The prior art has also included molded solid plastic bodies which typically have had flat top surfaces.

SUMMARY OF THE INVENTION

The present invention provides an improved guitar construction which provides a guitar body having much of the aesthetic desirability of a traditional complex carved top wooden guitar. This is accomplished, however, at a much lower cost.

A stringed musical instrument is provided having a solid body which has a length and a width. The body has a top surface shaped so that a widthwise cross section through the body intersects the top surface along a line defining a curved line, and so that a lengthwise cross section through the body intersects the top surface along a straight line. Thus, a simple developable curve is provided.

A sheet of wood veneer can be very easily applied to this simple developable curve without the need for applying heat, steam, etc., to deform the veneer into a complex curve.

The body itself can be constructed of plastic or wood. Preferably it is constructed from molded plastic.

The combination of molded plastic body having the simple developable curved top of the present invention with a wood veneer layer placed thereon provides an instrument which is very economical to manufacture yet has much of the aesthetic appeal of a traditional carved top wooden guitar.

Numerous objects, features and advantages of the present invention will be readily apparent to those skilled in the art upon a reading of the following disclosure when taken in conjunction with the accompanying drawings.

DETAILED DESCRIPTION OF THE PREFERRED EMBODIMENTS

Figure 1:
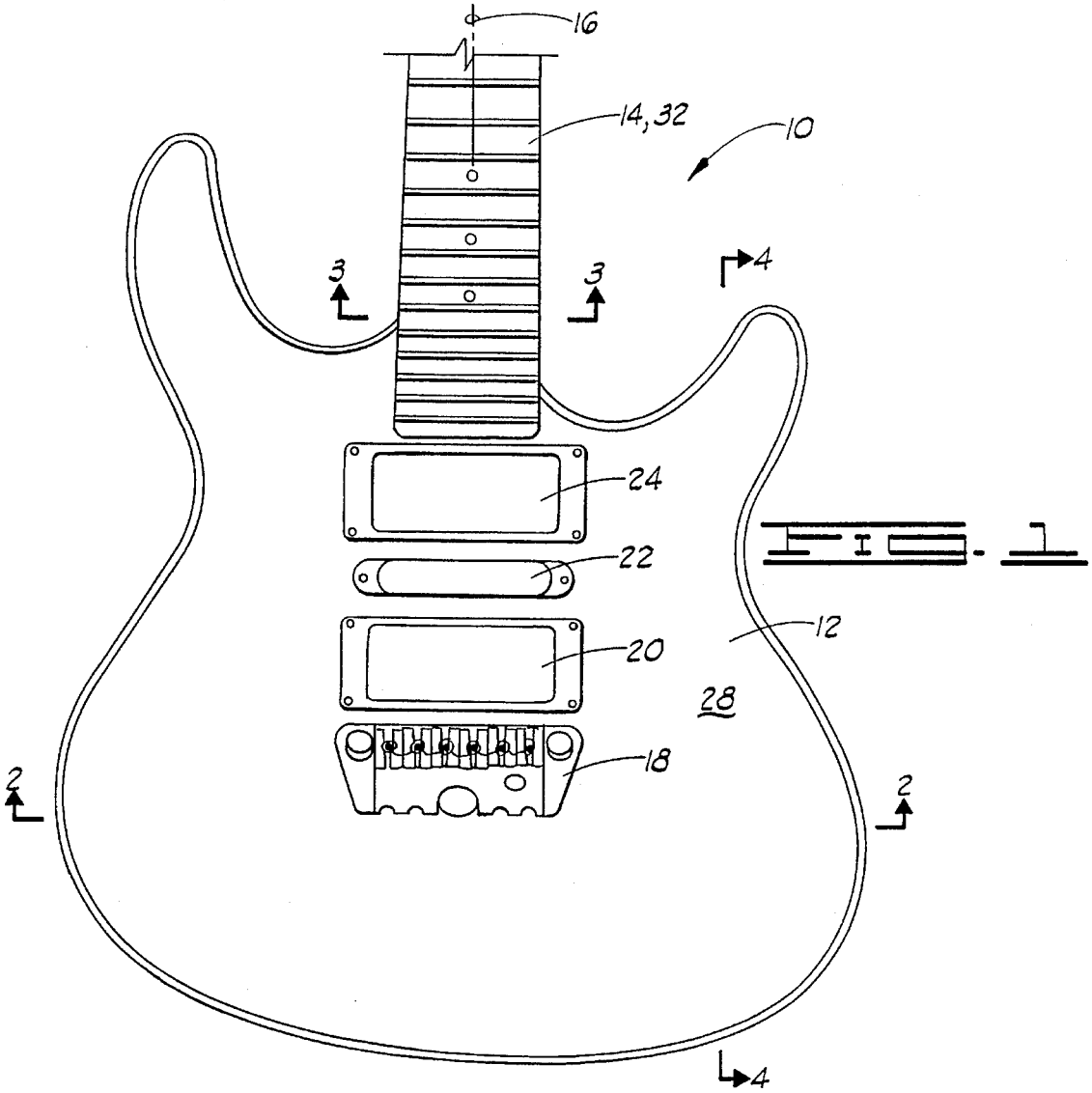
FIG. 1 is an elevation view of the body portion and part of the neck of a stringed musical instrument, namely a guitar.

Referring now to the drawings, and particularly to FIG. 1, the stringed musical instrument of the present invention is shown and generally designated by the numeral 10. The instrument 10 has a body 12 and a neck 14 extending from the body 12. A longitudinal axis 16 of both the body 12 and the neck 14 lies parallel to a length of the body 12. The width of the body 12 is considered to be perpendicular to the longitudinal axis 16.

Mounted on the body 12 are a conventional bridge/tailpiece 18 and a plurality of pickups 20, 22 and 24. Six strings (not shown) are strung along the length of the neck 14 from the tailpiece 18 to the nut (not shown) at the outer end of the neck 14.

Figure 2:
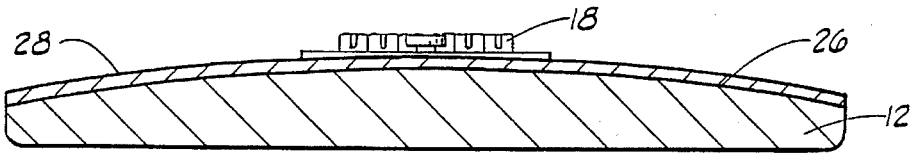
FIG. 2 is a typical widthwise cross-sectional view of the body taken along line 2—2 of FIG. 1 and illustrating the simple developable curved top surface of the body.
Figure 4:
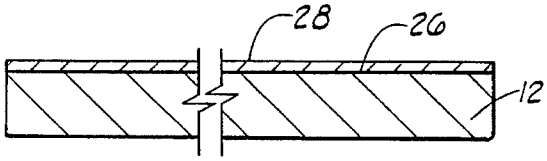
FIG. 4 is a typical lengthwise cross-sectional view of the body taken along line 4—4 of FIG. 1.

As shown in the typical widthwise and lengthwise cross-sectional views of FIGS. 2 and 4, respectively, the body 12 has a top or front surface 26 shaped in a manner defined herein as a "simple developable curve ". Such a simple developable curved surface has two aspects, namely its typical widthwise cross section and its typical lengthwise cross section, which combined together, define a curved surface upon which a sheet of material, such as veneer, can be laid and to which the sheet can be easily conformed by bending of the sheet only along one axis, in this case widthwise, while the sheet remains straight along the other axis, in this case lengthwise.

The body 12 also has a bottom or back surface 27, at least a portion of which is flat.

As shown in the cross-section view of FIG. 2, the body 12 has the top surface 26 shaped so that a typical widthwise cross section through the body 12 intersects the top surface 26 along a curved line. Preferably, this is a continuous convex curve, although it is noted that the curve could also include concave portions. More preferably, the continuous convex curve is an arc of constant radius.

FIG. 4 illustrates a typical lengthwise cross-sectional view through the body 12 showing that cross-section intersecting the top surface 26 along a straight line.

A wood veneer 28 has been bonded to the top surface 26 as seen in FIGS. 2 and 4. It will be appreciated that a wood veneer can be much more easily applied to a simple developable curve than it could be to a complex curved surface having curves along both the length and width of the body. Thus a relatively thick layer of high quality wood veneer can be placed upon the instrument 10. This is contrasted to prior art veneered products which have used veneer on the top of complex curves and which have had to use very thin veneers and/or used expensive and complex processes in order to-cause the veneer to comply with and bond to the complex curved top surfaces.

With the present invention having the veneer 28 applied to a simple developable curve, the veneer can be applied by relatively inexpensive techniques. One manner for applying the veneer is the use of a vacuum bag. Another technique for applying the veneer is the use of a sheet of cloth pulled over the edges of the instrument to apply a force holding the veneer in place over the top surface of the instrument while it is bonded thereto. A third technique is the use of a rubber mold to press the veneer and the guitar body together. All of these processes can be accomplished without the need for steam-treating of the veneer or other techniques which would be required with more complex curved surfaces.

The body 12 can be milled from wood, or more preferably it is molded from a plastic material. The plastic material can include any of the commonly used plastic composite materials.

Preferably the curve defined by the cross-section through the top surface 26 as shown in FIG. 2 defines an arc of constant radius. Such a constant radius arcuate curve can be easily formed with a milling machine or the like if the body 12 is formed of wood. This shape can also be easily molded if the body is formed of plastic.

Figure 3:
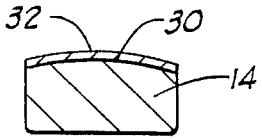
FIG. 3 is a cross-section view taken along line 3—3 of FIG. 1 showing the cross section of the neck of the guitar to be a planar extension of the curved top of the body of the guitar.

As is apparent in FIG. 3, the neck 14 also has a curved top surface 30. Preferably the curved top surface 30 is of the same curvature as the top surface 26 of body 12 adjacent the neck, and the curved top surface 30 of the neck 14 is an extension of the adjacent curved top surface 26 of the body 12. Also, a wood veneer layer 32 is bonded to the top surface 30 of the neck 14. The wood veneer layer 32 will typically be a different material than the wood veneer surface 28, since the upper surface of the fingerboard is subjected to much more extreme wear. One advantage provided by this construction of the neck 14 is that it allows the top surface 30 of the neck 14 or of the veneer 32 to be milled while the neck 14 is already attached to the body 12.

The neck 14 can be constructed of wood or more preferably it is molded from plastic material. The neck 14 and body 12 can be a single integral plastic molding if desired.

Thus it is seen that the apparatus and methods of the present invention readily achieve the ends and advantages mentioned as well as those inherent therein. While certain preferred embodiments of the invention have been illustrated and described for purposes of the present disclosure, numerous changes may be made by those skilled in the art, which changes are encompassed within the scope and spirit of the present invention as defined by the appended claims.

What is claimed is:

1. A guitar, comprising:

a body having length and a width and having a front surface, said front surface being shaped so that a cross section through said body across said width at any and all points along said length of said body intersects said front surface along a line defining a curve which is continuously convex and so that all lengthwise cross sections through said body intersect said front surface along a straight line ending at a distinct break line at each end of said straight line, and said body having a back surface at least a portion of which defines a flat planar surface.

2. The guitar of claim 1, wherein said curve is an arc of constant radius.

3. The guitar of claim 1, wherein:

said body is a solid wooden body.

4. The guitar of claim 1, further comprising:

a wood veneer layer bonded to said front surface.

5. The guitar of claim 1, wherein said front surface is a wooden front surface.

6. A guitar comprising a body having a front surface, said front surface having a length and a width, said front surface being shaped so that a cross section through said body across said width at any and all points along said length of said front surface, intersects said front surface along a line defining an arc of constant radius, and so that all lengthwise cross sections through said body intersecting said front surface intersect said front surface along a straight line, and said body having a back surface at least a portion of which defines a flat planar surface.

7. The guitar of claim 6, wherein said front surface is a wooden front surface.

8. The guitar of claim 6, wherein said body is a solid wooden body.

9. The guitar of claim 6, further comprising a wood veneer layer bonded to said front surface.

10. The guitar of claim 6, wherein all lengthwise cross sections through said body intersect said front surface along a straight line ending at a distinct break line at each end of said straight line.

11. A method of manufacturing a stringed musical instrument, comprising:

molding a plastic body having a forward facing a peripheral edge which defines an arc of constant radius of a cylinder having a longitudinal axis parallel to a length of said body.

12. A guitar, comprising:

a molded plastic body having a forward facing peripheral edge which defines an arc of constant radius of a cylinder having a longitudinal axis parallel to a length of said body.

* * * * *